US007434629B2

(12) United States Patent
Hodges et al.

(10) Patent No.: US 7,434,629 B2
(45) Date of Patent: Oct. 14, 2008

(54) TIRE FIRE SUPPRESSION AND VEHICLE WITH SAME

(75) Inventors: Steven Edward Hodges, Santa Barbara, CA (US); Gregory Deane Simpson, Goleta, CA (US)

(73) Assignee: Kidde Technologies Incorporated, Wilson, NC (US)

( * ) Notice: Subject to any disclaimer, the term of this patent is extended or adjusted under 35 U.S.C. 154(b) by 154 days.

(21) Appl. No.: 11/141,881

(22) Filed: May 31, 2005

(65) Prior Publication Data

US 2006/0278412 A1 Dec. 14, 2006

(51) Int. Cl.
*A62C 37/10* (2006.01)
*A62C 3/07* (2006.01)
*A62C 3/08* (2006.01)

(52) U.S. Cl. ..... 169/60; 239/62; 239/58; 239/46; 239/9; 239/54; 280/727; 280/737; 280/742

(58) Field of Classification Search ..... 169/54, 169/62, 60, 27, DIG. 3, 58, 46, 9; 280/727, 280/737, 742
See application file for complete search history.

(56) References Cited

U.S. PATENT DOCUMENTS 3,387,662 A * 6/1968 Molgano, Jr. ..... 169/26
3,464,497 A * 9/1969 Kaplan et al. ..... 169/60
3,568,774 A * 3/1971 Meoule ..... 169/60
3,788,400 A 1/1974 Tufts
3,860,073 A * 1/1975 Willms ..... 169/20
3,878,898 A * 4/1975 Marshall ..... 169/60
4,129,185 A * 12/1978 Hasselbacher ..... 169/62
4,332,368 A 6/1982 Woloszczuk
4,333,468 A * 6/1982 Geist ..... 604/180
4,383,579 A * 5/1983 Monk ..... 169/62
4,986,365 A 1/1991 Shieh
5,613,564 A * 3/1997 Rhines ..... 169/61
6,352,121 B1 * 3/2002 Pitell et al. ..... 169/62
6,644,415 B1 11/2003 Mohamed
6,955,226 B2 * 10/2005 Akins et al. ..... 169/19

FOREIGN PATENT DOCUMENTS

EP 1 393 778 A1 3/2004

* cited by examiner

*Primary Examiner*—Len Tran
*Assistant Examiner*—James S Hogan
(74) *Attorney, Agent, or Firm*—Merchant & Gould PC

(57) ABSTRACT

A vehicle having a tire fire suppression system includes a vehicle body for transportation of occupants or cargo. A plurality of combustible tires is connected to the body. The tires are susceptible to auto-ignition in response to exposure to an elevated temperature condition. The fire suppression system is connected to the body and includes a container of a fire suppressant. At least one temperature sensor is positioned in close proximity to at least one of the tires. The temperature sensor is adapted to be activated in response to the elevated temperature condition and before the auto-ignition. At least one nozzle is positioned to direct the suppressant toward the tire. An actuator connects the container to the nozzle for the suppressant to be dispersed from the nozzle in response to activation of the sensor.

18 Claims, 5 Drawing Sheets

TIRE FIRE SUPPRESSION AND VEHICLE WITH SAME

I. BACKGROUND OF THE INVENTION

1. Field of the Invention

This invention pertains to apparatus for suppressing fires. More particularly, this invention pertains to such an apparatus for suppressing fires associated with vehicle tires.

2. Description of the Prior Art

From time to time, motor vehicles equipped with synthetic rubber tires may be at risk of exposure of the tires to fire or other extreme heat which may cause or contribute to ignition of the tires. For example, law enforcement vehicles are exposed to many threats during riots or other civil disturbances. Other peacekeeping vehicles (such as military vehicles) are subject to similar threats.

Unfortunately, a common threat exposure for such peacekeeping vehicles (and their occupants) is combustible materials which lie in the path of the vehicle or which are projected at the vehicle. A frequently encountered threat is a so-called Molotov cocktail which is a container (such as a glass bottle) filled with a flammable fluid (such as gasoline) and corked with a rag (that acts as a wick) which is ignited and then thrown at the vehicle with the intent of disabling the vehicle and causing serious injury or death to the occupants. When the bottle strikes the vehicle it shatters and the flammable liquid is ignited by the burning rag and spreads causing a large dangerous fire.

When a flame surrounds a tire, the exterior of the tire is exposed to the extreme heat of the flame. After a period of time (depending on the exposure and the amount of flammable material surrounding the tire as well as the type of the tire), the temperature could exceed the auto-ignition temperature of the tire material (approximately 350° C.) so that the tire fire becomes self-sustaining. In such an event, the fire is referred to as "deep seated" within the tire.

A deep-seated fire tire is an extremely dangerous event. The mass of the tire presents a substantial mass of combustible material which burns at extremely high temperatures (for example, 1,100° C.). Also, the fumes from the burning tire may be highly toxic. A deep-seated fire tire can quickly result in loss of a vehicle, its contents, and, tragically, its occupants.

During a threat condition (when flammable materials are being projected at a vehicle), the condition of the tires is not readily apparent to the occupants of the vehicle. The occupants' attention is focused externally on the threat. Also, the design of the vehicle may not permit inspection of tires. For example, specialty equipped riot control vehicles may have very small window openings precluding a field of view to the tires.

A tire may be exposed to flames in the initial stages of burning but not yet at a deep-seated condition. If the occupants can extinguish the fire at the tires before the fire becomes deep-seated, the danger associated with the fire can be substantially mitigated. However, once the fire becomes deep-seated, a substantial amount of fire suppressant material (normally requiring specialty fire equipment—such as full capacity fire engine) is needed to treat the fire in a manner sufficient to save the occupants or the contents of the vehicle. During peacekeeping functions, there are insufficient numbers of such specialty fire equipment to permit their sufficiently rapid response to address deep-seated fire threats of peacekeeping vehicles.

During a peacekeeping mission, police officers, military personnel or the like cannot safely exit their vehicles to inspect a potential tire fire and to treat such a fire with hand-held fire extinguishers or the like. Further, during such peacekeeping missions, such occupants cannot safely evacuate a vehicle to escape the dangers of a deep-seated tire fire. Such evacuations expose the occupants to a wide variety of dangerous threats during a riot condition. These threats include risk of substantial injury or death associated with projectiles, small arms fire and other hazards.

There is a need to equip such vehicles with fire suppression systems to extinguish a tire fire before it becomes deep-seated. It is an object of the present invention to provide such a system. It is a further object of the present invention to provide for a vehicle having a tire fire suppression system which is automatic. A still further object of the present invention is to provide a tire fire suppression system which is rugged in construction and has a quick and reliable mechanism for assessing the operational readiness of the system before entering a threat situation.

II. SUMMARY OF THE INVENTION

According to a preferred embodiment of the present invention, a vehicle is disclosed having a tire fire suppression system. The vehicle includes a vehicle body for transportation of occupants or cargo. A plurality of combustible tires is connected to the body. The tires are susceptible to auto-ignition in response to exposure to an elevated temperature condition. The fire suppression system is connected to the body and includes a container of a fire suppressant. At least one temperature sensor is positioned in close proximity to at least one of the tires. The temperature sensor is adapted to be activated in response to the elevated temperature condition and before the auto-ignition. At least one nozzle is positioned to direct the suppressant toward the tire. An actuator connects the container to the nozzle for the suppressant to be dispersed from the nozzle in response to activation of the sensor. The apparatus may also be used for a wide variety of fire threat situations including detection and treatment of threats remote from a contained fire suppressant as well as threats in close proximity to the contained fore suppressant.

III. BRIEF DESCRIPTION OF THE DRAWINGS

IV. DESCRIPTION OF THE PREFERRED EMBODIMENT

With reference now to the various drawing figures in which identical elements are numbered identically throughout, a description of the preferred embodiment of the present invention will now be provided.

Figure 1:
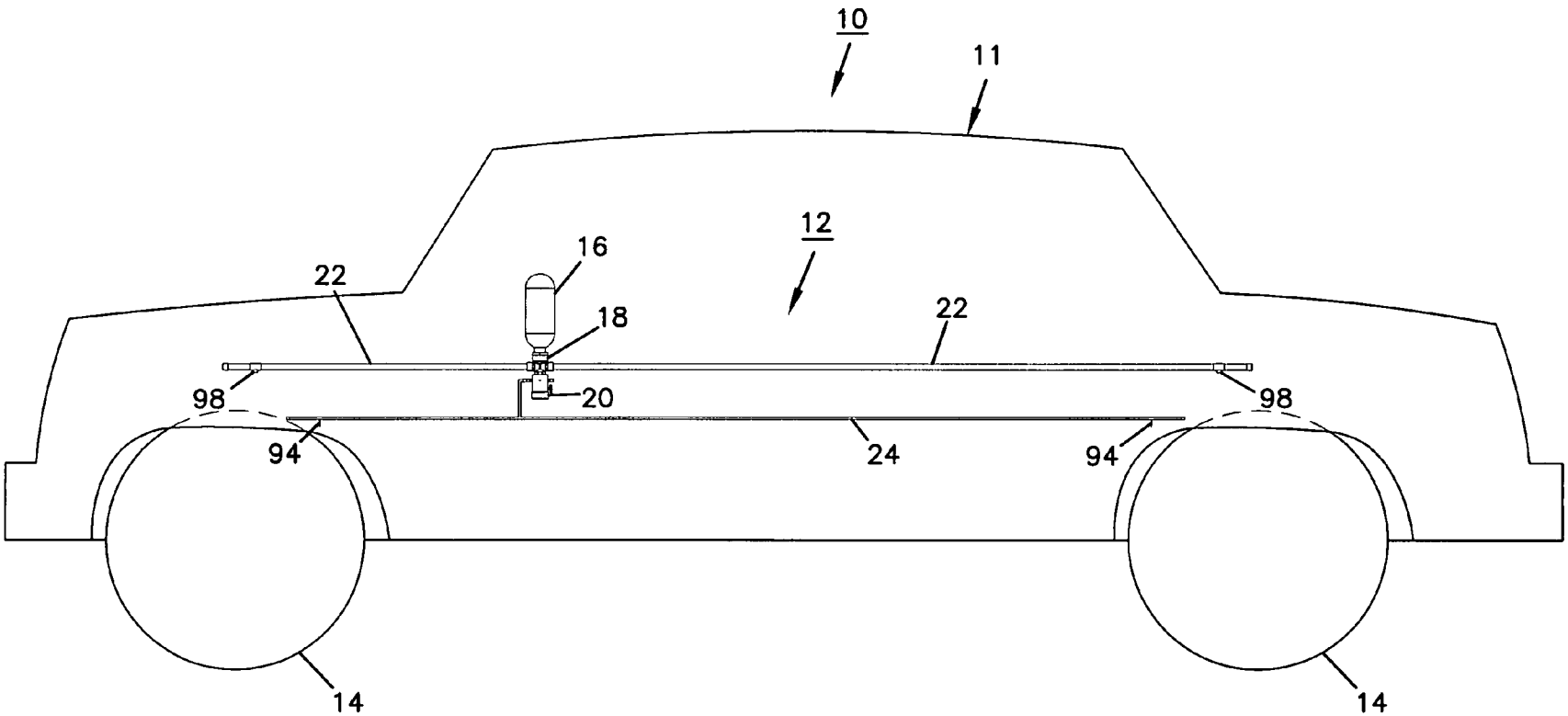
FIG. 1 is a side elevation view of a tired vehicle having a tire fire suppression apparatus according to the present invention.

FIG. 1 schematically illustrates a vehicle 10 equipped with a fire suppression apparatus 12. Vehicle 10 includes a plurality of tires 14 for supporting a vehicle body 11 on a roadway. The tires 14 are characterized as synthetic rubber tires which are susceptible to auto-ignition in response to exposure to an elevated temperature condition. Tire composition varies from tire to tire. By way of non-limiting representative example, a styrene butadiene rubber tire experiences auto-ignition after exposure to a temperature of 343° C.

The vehicle 10 may be any vehicle for carrying occupants or cargo. For example, vehicle 10 could be a peacekeeping vehicle such as a police officer automobile, a military personnel carrier or the like. Also, the vehicle 10 could be a civilian purpose vehicle having need for tire fire suppression. Such vehicles may include school buses, transit buses, or any other tired vehicle. While such civilian uses do not normally experience the high threat condition associated with riots or other peacekeeping functions, tire fire suppression may be desirable in such vehicles due to the catastrophic consequences if such a fire were to occur. For example it is not uncommon for a transit bus to experience a tire fire comprised of lodged debris (e.g., a mattress) being ignited by hot brake component surfaces.

Figure 2:
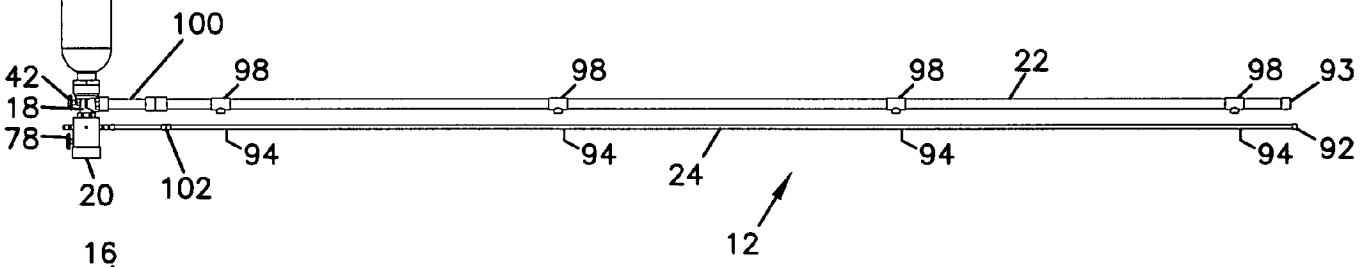
FIG. 2 is a side elevation view of the tire fire suppression system shown in an embodiment for ease of illustration with a distribution conduit extending in a straight line.
Figure 3:
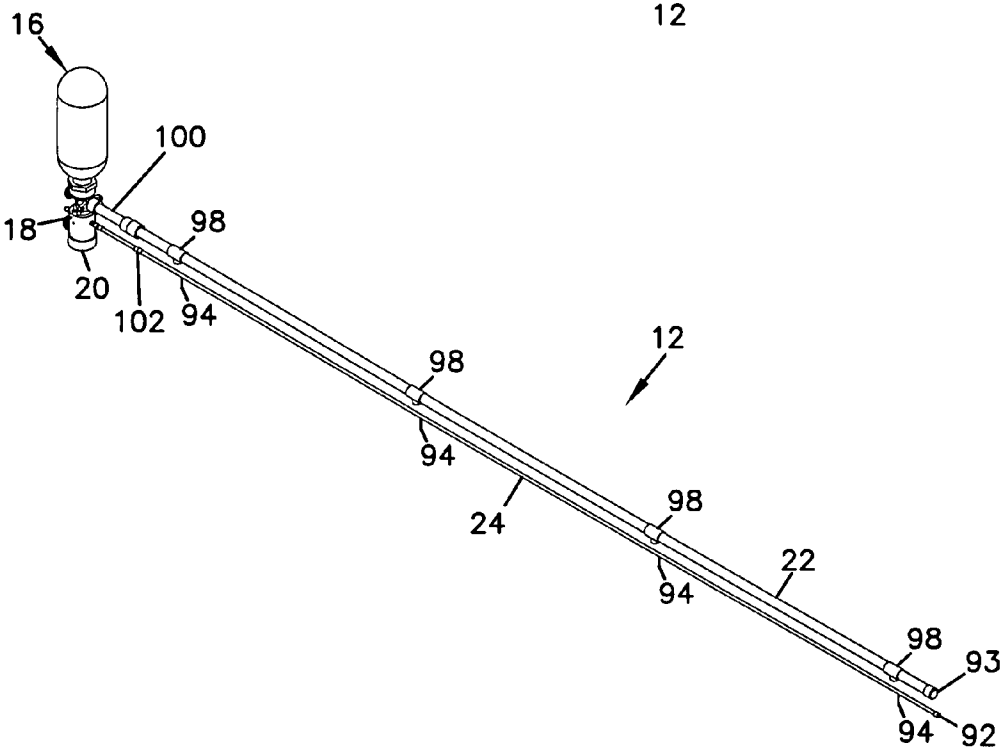
FIG. 3 is a perspective view of the suppression apparatus of FIG. 1.

With reference to FIGS. 2 and 3, the fire suppression apparatus 12 is shown separate from the vehicle 10 for ease of illustration and explanation. The apparatus 12 includes a cylinder 16, a release valve 18, a pilot valve 20, a distribution conduit 22, and a pilot tube 24.

The cylinder 16 contains a fire suppressant material which may be any fire suppressant material which can be ejected as a flowable substance. In the preferred embodiment, the cylinder 16 contains from 5 to 25 pounds of dry chemical fire suppressant material. An example of such material is siliconized potassium bicarbonate. Another example is water-based aqueous film forming foam (AFFF), possibly with a freeze point depressant additive.

Figure 12:
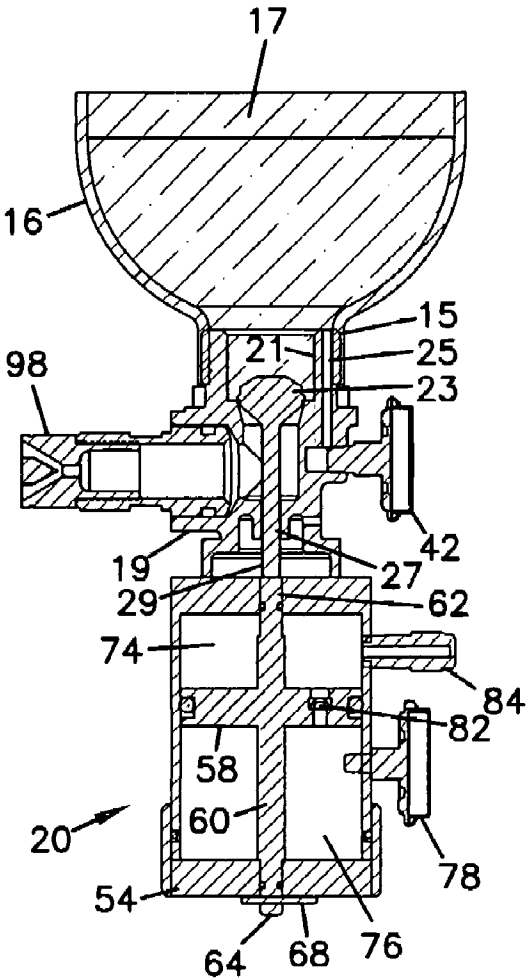
FIG. 12 is a view taken along line 12-12 of FIG. 11 and showing the assembly in a pre-actuated state.

The cylinder 16 may be filled with nitrogen or other gas under pressure (for example, at 360 pounds per square inch). A lower end of the cylinder 16 has a female threaded outlet port 15 (FIG. 12). The port 15 receives a male threaded inlet 21 (FIG. 12) of a releasing valve (such as valve 18 as will be described).

The use of terms "upper" and "lower" are used with reference to the orientation of the apparatus 12 and its components as shown in the drawings. In use, the components may be arranged in any orientation since gravity does not alter performance as described herein.

Upon activation of the releasing valve, the suppressant is ejected from the cylinder under influence of the pressurized gas. In a preferred embodiment for use in high threat situations involving small arms fire, the cylinder 16 is preferably a so-called non-shatterable cylinder (e.g., meets standards MIL-DTL-7905) selected to withstand impact from shrapnel or tumbling bullet rounds. It will be appreciated that such cylinders are commercially available items (such as commercial products 83-131010-001 of Kidde Fenwal, Ashland, Mass., USA or the non-shatterable P/N 372555 of Kidde Aerospace, Wilson, N.C., USA) and form no part of this invention per se.

The cylinder 16, release valve 18 and pilot valve 20 are shown assembled in FIGS. 10-13. In the embodiment of FIGS. 10-13, these elements are shown combined with other elements (including a nozzle 98 and eutectic tip 94) for sensing a fire threat in close proximity to the cylinder 16 and for spraying a suppressant 17 from a nozzle 98 in close proximity to the cylinder 16. The assembly is the same as in FIGS. 2 and 3 except only that FIGS. 2 and 3 have a pilot tube 24 connecting the eutectic tips 94 to the pilot valve 20 (instead of the direct connection shown in FIGS. 10 and 11) and FIGS. 2 and 3 have a distribution conduit 22 connecting nozzles 98 to the release valve 18 (instead of the direct connection shown in FIGS. 10 and 11). The embodiment of FIGS. 2 and 3 is adapted for detecting and treating fire threats remote from the cylinder 16 while the embodiment of FIGS. 10-13 is adapted for detecting and treating threats in close proximity.

The release valve 18 (shown best in FIGS. 10-13 is a commercially available product such as product Part No. 83-878767 of Kidde Fenwal, Ashland, Mass., USA. The valve 18 has an outlet port 19 (FIG. 12) connected to the distribution conduit 22 (or directly to a nozzle 98 as shown in FIGS. 10-13). An internal piston 23 is contained within the valve 18. Pressurization in the cylinder 16 urges the piston 23 to a closed or pre-actuated position (FIG. 12) preventing communication between the inlet 21 of the valve 18 and the valve outlet 19.

The valve 18 also includes a gauge 42 connected by an internal conduit 25 to the interior of the cylinder 16. The gauge 42 may be visually inspected by an operator with the gauge presenting a visual indication of pressure within the cylinder 16. As a result, an operator may readily assess the operational readiness of the apparatus 12 by noting an elevated pressure at gauge 42 which indicates the presence of fire suppressant within the cylinder 16. When the internal piston 23 of the valve 18 is displaced in a direction co-linear with a shaft 27 of the piston 23 (upwardly in the view of FIGS. 12 and 13), the valve 18 is in an open or actuated position (FIG. 13) with the contents 17 of the cylinder 16 flowable to the outlet port 19. An end 29 of the shaft 27 is exposed through the bottom of the valve 18.

The pilot valve 20 is positioned on the side of the release valve 18 opposite the cylinder 16. The pilot valve 20 acts to urge the piston 23 of the release valve 18 to the open position in response to a sensed condition indicating risk of tire fire (i.e., a significantly elevated temperature). The pilot valve 20 is separately shown in FIGS. 4-9.

Figure 8:
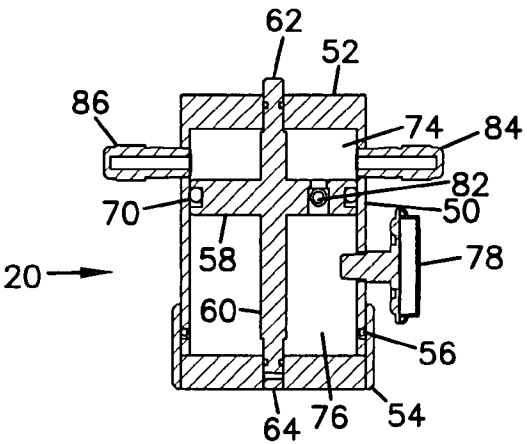
FIG. 8 is the view taken along lines 8-8 of FIG. 7.
Figure 7:
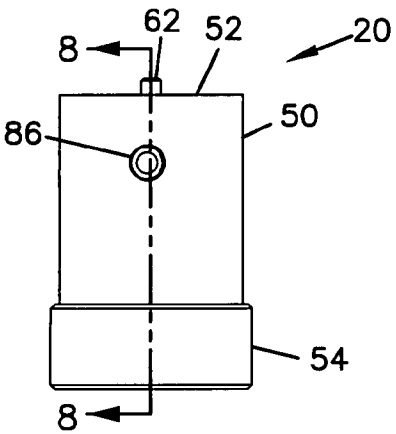
FIG. 7 is the view of FIG. 5 with the pilot valve assembly shown in an actuated state.
Figure 11:
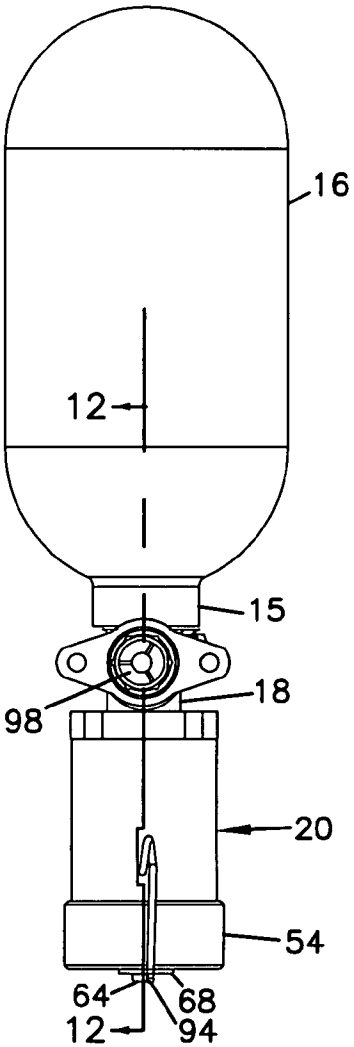
FIG. 11 is a front side elevation view of the assembly of FIG. 10.
Figure 10:
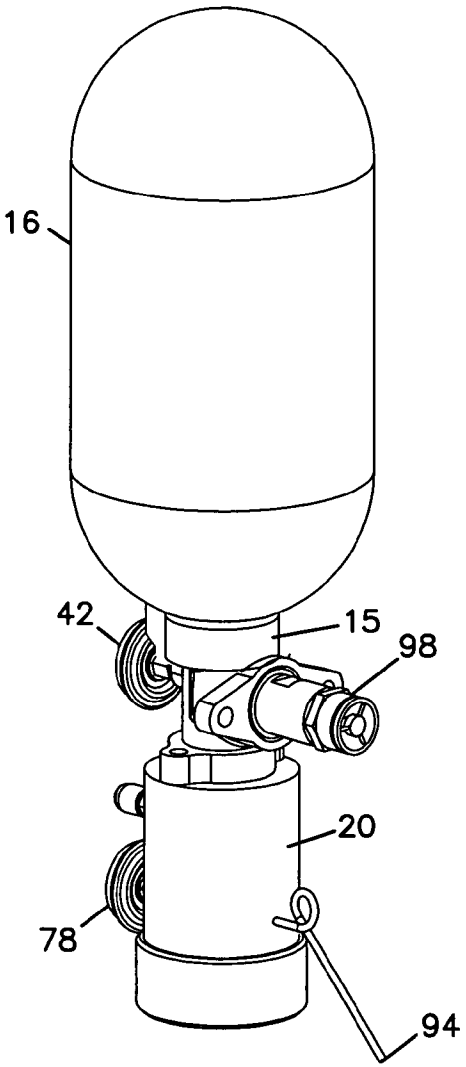
FIG. 10 is a perspective view for a modified assembly of the present invention for detection and treatment of fire threats in close proximity to the assembly.

The pilot valve 20 includes a cylindrical housing 50 having a closed upper end 52 and a closed lower end 54. The lower end 54 is in the form of a cylindrical cap which is sealed against the housing by an O-ring 56 or similar sealing mechanism (FIGS. 6 and 8).

Figure 13:
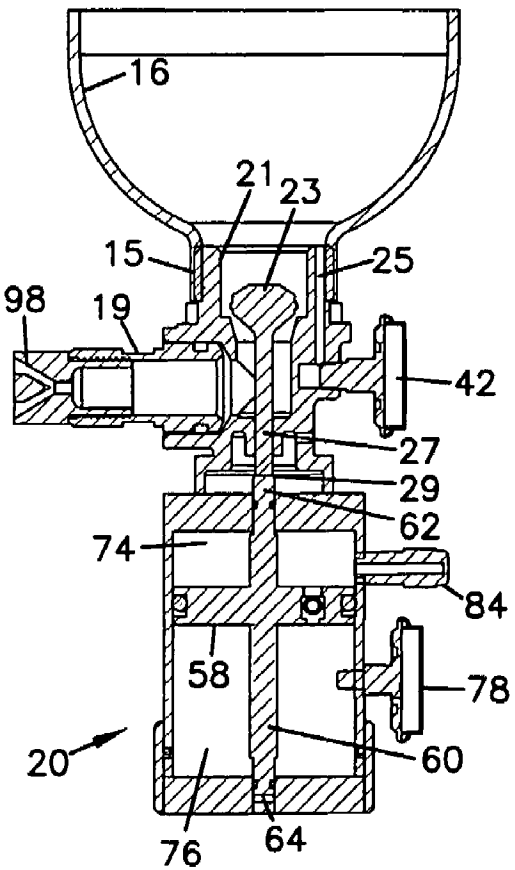
FIG. 13 is the view of FIG. 12 showing the assembly in an actuated state.

A piston 58 is mounted within the housing with a piston shaft 60 axially movable within the housing 50. An upper end 62 of the shaft passes through a centrally positioned hole on the upper end 52 and is sealed with an o-ring or similar sealing mechanism. As best shown in FIGS. 12 and 13, the upper end 62 opposes and abuts the lower end 29 of shaft 27 of release valve 18. The shafts 27, 60 are linearly aligned such that an upward motion (in the view of the figures) of shaft 60 causes an upward movement of shaft 27.

A lower end 64 of the shaft slides within a hole centrally formed in the lower end 54 and is sealed with an o-ring or similar sealing mechanism. The central portion of the shaft 60 is enlarged beyond the diameter of the ends 62, 64 to limit the travel of the piston 58 within the housing 50.

Figure 6:
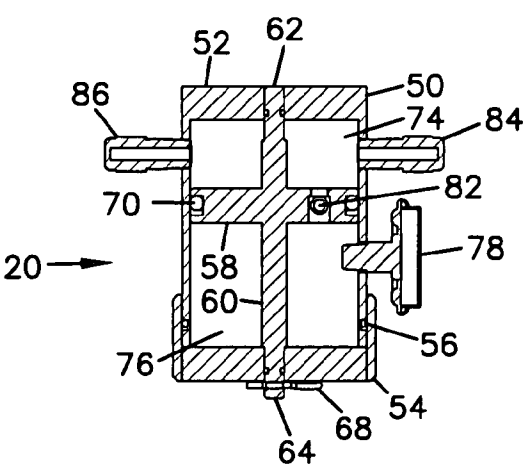
FIG. 6 is a view taken along lines 6-6 of FIG. 5.
Figure 5:
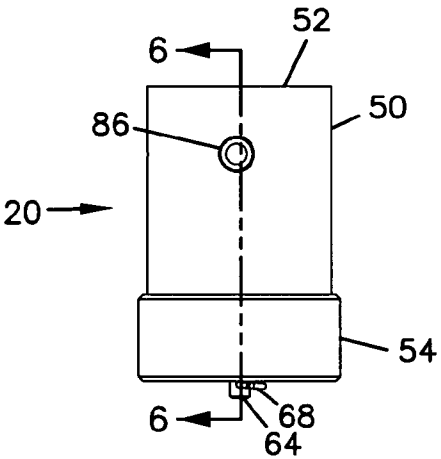
FIG. 5 is a side elevation view of the pilot valve assembly of FIG. 4 with a valve assembly in a pre-actuated state.
Figure 4:
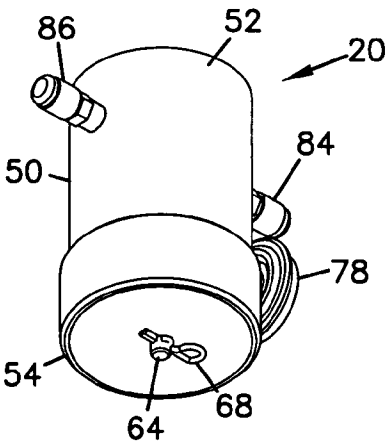
FIG. 4 is a bottom and side perspective view of a pilot valve assembly for use in the fire suppression system of FIG. 2 shown in a pre-actuated state (with a safety pin in place)
Figure 9:
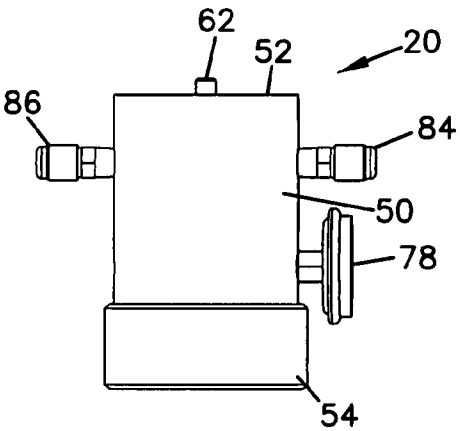
FIG. 9 is a side elevation view of the pilot valve assembly rotated 90° from the view of FIG. 7.

FIG. 6 illustrates the pilot valve 20 in a pre-actuated state with the upper end 62 fully recessed within the opening of the upper end of the housing 52. The lower end 64 of the shaft protrudes beyond the lower end 54 of the housing 50. This exposes a hole passing through the diameter of the lower end 64 such that a safety pin 68 may be passed through the hole through the shaft 60 at end 64 and hold the piston 58 in the pre-actuated state. FIG. 8 illustrates the pilot valve 20 in an actuated state with the upper end 62 protruding from the opening of the upper end of the housing 52

The safety pin 68 prevents accidental movement of the pilot valve 20 to the actuated position during storage, shipping or periods of non-use. The safety pin 68 may be removed prior to moving into a threat position such as use of a police vehicle during riot control.

An outer cylindrical wall of the piston 58 has a groove containing an O-ring 70 for sealing engagement against an interior wall of the housing 50. The lower end 64 and upper end 62 of the shaft 60 will also include O-rings to seal against the housing.

The piston 58 separates the housing 50 into an upper chamber 74 and a lower chamber 76. A commercially available gauge 78 through the wall of the housing communicates with the lower chamber 76 to monitor a pressure within the lower chamber 76. Gauge 78 provides a visual indication of high pressure (meaning the pilot valve 20 is charged). After discharge (as will be described), the lower chamber 76 remains pressurized. Operational readiness is assured by elevated pressure in chamber 76 (as indicated by gauge 78) and a visible safety pin hole in the lower end of the shaft (indicating the pilot valve has not already been shifted to the actuated position).

The piston 58 has a through hole with a check valve 82 biased to a closed position. Accordingly, pressurized air within the upper chamber 74 may urge the check valve 82 open so that the pressurized air flows into the lower chamber 76. However, the valve 82 blocks reverse flow. The gauges 78 respond to the pressurization of the lower chamber 76 and provide a reading that the lower chamber is pressurized.

The upper chamber 74 includes a fill port 84 and a discharge port 86. The fill port 84 may be releasably secured to any source of pressurized air to pressurize the interior of the housing 50 to a desired ready-state operating pressure (for example 100 psi). If desired, the fill port 84 may be connected to the cylinder 16 so that the pressurization in the cylinder 16 pressurizes the pilot valve 20.

The minimum required pilot valve pressure is a function of the surface area of the piston and the sealing force of the valve so that the surface area and the chamber pressure create a force on the shaft end to overcome the sealing force of the valve. The pressure should be less than a pressure which would damage the eutectic tips 94. The example of 100 psi avoids such damage.

The port 86 is connected to the pilot tube 24. The pilot tube 24 is an elongated hollow tube of durable material such as three-eighths inch (approximately 10 mm) stainless steel. The tube has a pipe-fitting end which is connected to the port 86. A distal end of the tube 24 is provided with a cap 92 to seal the interior of the tube 24.

At intermediate locations along its length, chosen to match the expected threat to the protected area, the tube 24 has a one or more of eutectic tips 94 sealed into holes formed through the wall of the tube 24. The eutectic tips 94 are commercially available items and form no part of this invention per se. A representative product is product Part No. A800101 of Kidde Aerospace, Wilson, N.C., USA. The tips 94 are selected to degrade in response to an elevated temperature condition (for example, 170-174° F. or 77-79° C.) after a very short exposure to such temperature (e.g., within about 10 seconds). The degraded tips 94 permit communication of the interior of the tube 24 with ambient atmospheric conditions. The tips are one-eighth inch (approximately 3 mm) stainless steel tubes with distal ends capped by a eutectic material welded on the ends.

With the construction thus described, when the interior of the pilot valve 20 is pressurized and tips 94 are intact, the pressurized air from the housing 50 fills the pilot tube 24 and retains in a static pressurized state.

As previously noted, the discharge conduit 22 extends from the release valve outlet. One or more nozzles 98 are disbursed along the length of the discharge conduit 22 to disperse the fire suppressant as it is being urged from the cylinder through the valve 18 and through the discharge conduit 22. If desired, the conduit 22 can be tapered in diameter or varied in diameter along its length for an even distribution of suppressant from the nozzles 98.

The discharge conduit 24 is formed of a rugged material such as three-quarter inch (approximately 19 mm) metal or heavy-duty plastic tubing. The end of the tube 24 has a dust cap 93 or similar device to cover and protect a nozzle (not shown but identical to nozzles 98) to protect the nozzle from being clogged by debris. Any or all nozzles 98 can be protected by a dust cap 93. The cap 93 blows off in response to fire suppressant flow. Each of the discharge conduit 22 and the pilot tube 24 may be provided with one or more flexible joints 100, 102 along their length and preferably at the connection to the valves 18, 20.

With the construction thus described, the release valve 18 is biased to a normally closed position preventing discharge of the contents of the cylinder 16 into the discharge conduit 22. The pilot valve 20 is in the pre-actuated state of FIG. 6 with an elevated pressure contained within the upper and lower chambers 74, 76 and with the pressure maintained within the pilot tube 24.

In the event any one of the eutectic tips 94 experiences an elevated temperature, the effected eutectic tip 94 degrades permitting the pressurized air of the pilot tube 24 to be evacuated to atmosphere. This results in a pressure drop within the upper chamber 74 of the pilot valve 20.

The check valve 82 prevents the pressurized air in the lower chamber 76 from passing through the piston to the upper chamber 74. Accordingly, a pressure differential exists across the piston 58. With the safety pin 68 removed before moving the vehicle 10 into a threat position (such as deployment in a riot control operation), the piston 58 is free to move to the actuated position of FIG. 8. This causes the upper end 62 of the piston to protrude into the release valve 18 and urge the piston of the release valve 18 to move to an open position permitting flow of the pressurized contents of the cylinder 16 into the discharge conduit 22 and disbursement through the nozzles 98. The lower chamber remains pressurized.

For ease of illustration, the discharge conduit 22 and the pilot tube 24 are shown as elongated straight tubes. In practical operation, they may be bent or curved as needed for a particular application. Also, either of tubes 22, 24 can have multiple branches.

With reference to FIG. 1, the cylinder 16, release valve 18 and pilot valve 20 are mounted within the interior of a vehicle 10 to both protect these components from threat conditions as well as permitting an operator to easily inspect the gauges 42, 78 to assess the operational readiness of the fire suppression apparatus 12. Alternatively, these components may be mounted on the exterior of the vehicle with assessment of the gauges 42, 78 being performed before utilization of the vehicle in a threat environment.

The pilot tube 24 is curved and bent as needed so that the eutectic tips 94 are positioned in close proximity to the tires 14 to assess an elevated temperature in the vicinity of the tires 14. While placement of the eutectic tips 94 within a wheel well may be desirable, such a precise location is not necessary and may not be desirable for a particular application in the event there is inadequate clearance in a wheel well of the vehicle 10. Instead, the eutectic tips 94 may be positioned beneath the vehicle near the tires or at any suitable location to measure an abnormal elevated temperature such as would be experienced in the event of a fire in the vicinity of the tires.

The discharge conduit 22 is also secured to the body and bent and curved as needed for the nozzles 98 to be positioned to discharge their contents towards the tires 14. While it is preferred that the tubes 22, 24 be protected by the components of the vehicle 10, they may be mounted externally and formed of any suitable material to protect these tubes from damage in a threat condition.

With the structure thus described, the vehicle can be placed in a threat condition. In the event an elevated condition occurs near the tires 14 such that the tires 14 are at risk from combustion and auto-ignition, the eutectic tips 94 melt triggering movement of the pilot valve 20 to an actuated position resulting in discharge of the fire suppressant from the nozzles 98 onto the tires 14. This extinguishes the fire in a rapid manner before the fire at the tires 14 elevates to an auto-ignition state. This fire suppression is automatic and does not require the occupants of the vehicle 10 to exit the protection of the vehicle 10 in order to inspect the tires 14 or the fire suppression system 12.

A vehicle may be provided with several systems as described above. The systems may operate independently. Alternative, the systems can be joined so that the canisters of all systems discharge to their connected nozzles in the event of degradation of a eutectic tip of any system. In this arrangement, the upper chambers of the pilot valves of the several systems may be connected by conduits so that the upper chambers of all systems lose elevated pressure in the event of degradation of any one eutectic tip.

It having been shown how the objects of the invention have been attained in the preferred embodiment, modifications and equivalence of the disclosed concepts may occur to one of ordinary skill in the art. The invention is adapted to many different uses in addition to those described above. Examples of such include off-road mining and heavy industrial vehicles, foundry tractor fire protection systems, limousines (particularly, vehicles for dignitaries) and trains. It is intended that modifications and equivalents shall be included within the scope of the claims which are appended hereto.

What is claimed is:

1. A vehicle comprising:

a vehicle body for transportation of occupants or cargo;

a plurality of tires connected to said body with said tires susceptible to auto-ignition in response to exposure to an elevated temperature condition;

a fire suppression system connected to said body including:

a container of a fire suppressant;

at least one temperature sensor in proximity to at least one of said tires;

at least one nozzle disposed to direct said suppressant toward said at least one tire;

an actuator for connecting said container to said nozzle for said suppressant to be dispersed from said nozzle; said actuator including a chamber sealed from said container and having a gas at a chamber pressure greater than ambient air pressure with said actuator releasing said suppressant from said container to said nozzle in response to a reduction in said chamber pressure;

said chamber having a normally-closed discharge port to atmosphere, said discharge port connected to said temperature sensor to open to atmosphere in response to said sensor being exposed to said elevated temperature.

2. A vehicle according to claim 1 comprising a plurality of temperature sensors in proximity to each of said tires.

3. A vehicle according to claim 1 wherein said suppressant is contained under pressure within said container.

4. A vehicle according to claim 3 wherein said actuator includes:

a release valve for controlling a release of said suppressant from said container to said nozzles;

said release valve having an open state and a closed state, in said open state; in said open state, said release valve connecting said container and said nozzles in material flow communication;

in said closed state, said release valve blocking material flow from said container to said nozzle;

said release valve biased to said closed state.

5. A vehicle according to claim 4 wherein said actuator includes a pilot valve having a pre-actuation state and an actuation state, in said actuation state, said pilot valve urging said release valve to said open state.

6. A vehicle according to claim 5 wherein said pilot valve is biased to move to said actuation state in response to said reduction in said chamber pressure.

7. A fire suppression apparatus comprising:

a container of a fire suppressant;

at least one temperature sensor disposed remote from said container for sensing an elevated temperature condition at a location;

at least one nozzle disposed remote from said container for directing said suppressant toward said location;

an actuator for connecting said container to said nozzle for said suppressant to be dispersed from said nozzle; said actuator including a chamber sealed from said container and having a gas at a chamber pressure greater than ambient air pressure with said actuator releasing said suppressant from said container to said nozzle in response to a reduction in said chamber pressure;

said chamber having a normally-closed discharge port to atmosphere, said discharge port connected to said temperature sensor to open to atmosphere in response to said sensor being exposed to an elevated temperature.

8. An apparatus according to claim 7 wherein said at least one temperature sensor is one of a plurality of temperature sensors each disposed remote from said container and responsive to said elevated temperature condition.

9. An apparatus according to claim 7 wherein said suppressant is contained under pressure within said container.

10. An apparatus according to claim 9 wherein said actuator includes:

a release valve for controlling a release of said suppressant from said container to said nozzles;

said release valve having an open state and a closed state, in said open state;

in said open state, said release valve connecting said container and said nozzles in material flow communication;

in said closed state, said release valve blocking material flow from said container to said nozzle;

said release valve biased to said closed state.

11. An apparatus according to claim 10 wherein said actuator includes a pilot valve having a pre-actuation state and an actuation state, in said actuation state, said pilot valve urging said release valve to said open state.

12. An apparatus according to claim 10 wherein said pilot valve is urged to said actuation state in response to said venting.

13. A fire suppression apparatus comprising:

a container of a fire suppressant;

a temperature sensor responsive to an elevated temperature condition;

a nozzle disposed direct said suppressant from said container toward a source of said elevated temperature condition;

a release valve for controlling a release of said suppressant from said container to said nozzle;

said release valve having an open state and a closed state, in said open state;

in said open state, said release valve connecting said container and said nozzle in material flow communication;

in said closed state, said release valve blocking material flow from said container to said nozzle;

said release valve biased to said closed state;

a pilot valve having a pre-actuation state and an actuation state, in said actuation state, said pilot valve urging said release valve to said open state, said pilot valve including a chamber sealed from said container and having a gas at a chamber pressure greater than ambient air pressure with said pilot valve moved to said activation state in response to a reduction in said chamber pressure, said chamber having a normally-closed discharge port to atmosphere, said discharge port connected to said temperature sensor to open to atmosphere in response to said sensor being exposed to said elevated temperature.

14. An apparatus according to claim 13 wherein said actuation valve includes a pressurized gas with said gas vented in response to said activation of said at least one sensor, said pilot valve moving to said actuation state in response to said venting.

15. An apparatus for actuating a main valve wherein said main valve has an exposed component moveable along a line of travel from a first position to a second position, said main valve further having an actuated state when said exposed component in said first position and a non-actuated state when said exposed component in said second position, said apparatus comprising a pilot valve having:

a housing;

a piston disposed within said housing and movable between a deactivated position and an activated position along a pathway and with said piston separating said housing into a first sealed chamber and a second sealed chamber; said first sealed chamber and said second chamber connected by a fluid path with a flow restrictor for substantially limiting fluid flow through said path in a direction from said first sealed chamber to said second sealed chamber and said piston movable to said activated position in response to a pressure drop in said first sealed chamber;

a first contact connected to said piston and movable therewith, said first contact disposed to urge said exposed component from said first position to said second position as said piston moves from said deactivated position to said activated position;

a sensor connected to said first sealed chamber to open to ambient atmosphere and vent a pressurized fluid from said first sealed chamber in response to a sensed event.

16. An apparatus according to claim 15 wherein said fluid flow path is formed through said piston.

17. An apparatus according to claim 15 including a pressure sensor for sensing a pressure in said second chamber.

18. An apparatus for actuating a main valve wherein said main valve has an exposed component moveable along a line of travel from a first position to a second position, said main valve further having an actuated state when said exposed component is in said first position and a non-actuated state when said exposed component is in said second position, said apparatus comprising a pilot valve having:

a housing;

a piston disposed within said housing and movable between a deactivated position and an activated position along a pathway and with said piston separating said housing into a first sealed chamber and a second sealed chamber; said piston movable to said activated position in response to a pressure drop in said first sealed chamber;

a first contact connected to said piston and movable therewith, said first contact disposed to urge said exposed component from said first position to said second position as said piston moves from said deactivated position to said activated position;

a sensor connected to said first sealed chamber to open to ambient atmosphere and vent a pressurized fluid from said first sealed chamber in response to a sensed event;

a second contact connected to said piston and movable therewith and adapted to be releasably fixed to said housing to releasably maintain said piston in said deactivated state.

* * * * *